United States Patent [19]

Miller et al.

[11] Patent Number: 4,904,373

[45] Date of Patent: Feb. 27, 1990

[54] FOSSIL RESIN FLOTATION FROM COAL BY SELECTIVE COAGULATION AND DEPRESSION OF COAL

[75] Inventors: Jan D. Miller; Qiang Yu; Ye Yi, all of Salt Lake City, Utah

[73] Assignee: University of Utah, Salt Lake City, Utah

[21] Appl. No.: 333,606

[22] Filed: Apr. 4, 1989

[51] Int. Cl.[4] ..... B03D 1/02; B03D 1/08

[52] U.S. Cl. ..... 209/167; 209/5

[58] Field of Search ..... 209/5, 166, 167

[56] References Cited

U.S. PATENT DOCUMENTS

| | | | |
|---|---|---|---|
| 1,773,997 | 8/1930 | Green . | |
| 2,506,301 | 5/1950 | Klepetko | 209/166 |
| 2,591,830 | 4/1952 | Klepetko | 209/166 |
| 2,784,468 | 3/1957 | Booth et al. . | |
| 3,394,893 | 7/1968 | Moss et al. . | |
| 3,456,792 | 7/1969 | Schoolcraft et al. . | |
| 3,847,357 | 12/1974 | Weston . | |
| 4,183,730 | 1/1980 | Dondelewski . | |
| 4,222,861 | 9/1980 | Finch . | |
| 4,222,862 | 9/1980 | Finch . | |
| 4,248,698 | 2/1981 | Keller, Jr. . | |
| 4,253,944 | 3/1981 | Hefner, Jr. . | |
| 4,305,815 | 12/1981 | Hefner, Jr. . | |
| 4,308,133 | 12/1981 | Meyer . | |
| 4,330,339 | 5/1982 | Nimerick . | |
| 4,377,473 | 3/1983 | Laros et al. . | |
| 4,426,282 | 1/1984 | Aunsholt . | |
| 4,450,070 | 5/1984 | Hefner, Jr. . | |
| 4,466,887 | 8/1984 | Gross . | |
| 4,474,619 | 10/1984 | Meyer et al. . | |
| 4,504,385 | 3/1985 | Keys . | |
| 4,514,292 | 4/1985 | Burdick . | |
| 4,537,599 | 8/1985 | Greenwald . | |
| 4,589,980 | 5/1986 | Keys . | |
| 4,606,818 | 8/1986 | Keys . | |
| 4,678,561 | 7/1987 | Keys . | |
| 4,678,562 | 7/1987 | Keys . | |
| 4,724,071 | 2/1988 | Miller | 209/167 |
| 4,761,223 | 8/1988 | Klimpel . | |
| 4,770,767 | 9/1988 | Hansen et al. . | |

FOREIGN PATENT DOCUMENTS

| | | | |
|---|---|---|---|
| 716609 | 2/1980 | U.S.S.R. | 209/167 |

*Primary Examiner*—David L. Lacey
*Assistant Examiner*—Thomas M. Lithgow
*Attorney, Agent, or Firm*—Trask, Britt & Rossa

[57] ABSTRACT disclosed is a process for separating resin from a mixture of resin-bearing coal particles by increasing the pH of a froth flotation process to a value of at least 12. Particles of reduced size resin-bearing coal are preferably mixed with water to from a slurry. The pH of the slurry is then adjusted with a chemical agent to about 12. The slurry is then subjected to froth flotation. The coal particles aggregate to one another allowing the remaining resin-rich particles to attach to the bubbles formed during the flotation process. A much improved separation efficiency for resin flotation from coal is observed.

17 Claims, 1 Drawing Sheet

FOSSIL RESIN FLOTATION FROM COAL BY SELECTIVE COAGULATION AND DEPRESSION OF COAL

BACKGROUND OF THE INVENTION

1. Field:

This invention relates to a method for treating coal, and more particularly to a method for separating resin from coal by froth flotation.

2. State of the Art:

Using froth flotation to remove and separate natural resin ("resins") from resin-bearing coal is well known. U.S. Pat. No. 1,773,997 (Green) is illustrative of the process. Resin-bearing coal is comminuted in the presence of two parts of water and passed through a 40 mesh screen. Another part of water is added, and the resulting pulp is introduced into a froth flotation machine. A frothing agent ("frother") such as amyl alcohol, is added to the pulp, and the mixture agitated. A froth forms which carries with it a certain portion of resin while the coal-predominant tailing remains.

The resultant resin-bearing froth is then retreated. The resinous froth is reintroduced into the flotation machine, water is added to fill the machine to a working level, and substances such as potassium alum, may be added. The resulting mixture is then agitated. More frothing agent is introduced, and a resin froth is taken from the flotation machine. Green reported that relatively pure (approaching 96% by weight) resin can be attained using the above two-step method.

Extracting resin from resin-bearing coal is particularly important in Western North America. There, certain coal fields contain significant quantities of resins. Other areas of the world having resin-bearing coal include Mainland China and Argentina.

The State of Utah has significant amounts of resin-bearing coal in its coal fields. The resins obtained from Utah coal generally have low specific gravities, approximately 1.03 g/cm$^3$, and vary in color from lemon yellow to almost black. The resins are important commercially, being used for adhesives, varnishes, coatings, waterproofing, linoleum, etc., and command a substantially higher price per pound as a chemical commodity than as a fuel.

Most prior art flotation techniques for resin recovery have not been particularly selective. Both components of the feed, resin and coal, have similar hydrophobic characteristics as shown by the contact angle and bubble attachment time data listed in Table 1. The difference between the bubble attachment times for resin and coal is insufficient to achieve the desired selective flotation separation by conventional flotation techniques.

The hydrophobic character of resin and coal from the Hiawatha, Utah seam is shown in Table 1. The bubble attachment time was measured at a particle bed with particle size 212×300 microns at a pH of 6.5.

TABLE 1

| Component | Contact Angle Degrees | Bubble Attachment Time (ms) |
|---|---|---|
| Resin | 58–59 | 5 |
| Coal | 48–51 | 15 |

U.S. Pat. No. 4,724,071 to Miller et al. discloses a selective flotation process in which coal particles can be selectively depressed by ozone conditioning. In this flotation process, a resin concentrate product which contains 95% resin at a recovery of 70–80% can be obtained in single stage flotation from resinous coal feed containing approximately 10% resin. Such a high purity concentrate product can be directly used as feed stock for some industrial applications cited before and the costly solvent refining processcan be eliminated in many cases. However, this ozone flotation process uses resinous coal ground to at least minus 200 mesh prior to ozone conditioning. Generally such grinding is not practiced at coal preparation plants.

SUMMARY OF THE INVENTION

Fossil resin recovery from coal by a pH modified selective flotation process has been accomplished. The process eliminates the need for grinding and can directly use minus 28 mesh material as feed to the flotation circuit.

The process includes forming a slurry of water and resin-bearing coal particles. The pH of the slurry is adjusted to above about 12 causing particles which are predominantly coal ("coal-rich particles") to aggregate while the particles which are predominantly resin ("resin-rich particles") remain dispersed. A frothing agent is then added to the pH adjusted slurry and the slurry is subjected to froth flotation. The coal-rich particles remain aggregated in the slurry while the resin-rich particles attach to bubbles, float and are collected in a froth product. The high grade resin concentrate produced by this selective flotation process is a preferred feed stock for subsequent refining since solvent consumption and filtration operations are reduced and are less costly than for concentrates obtained from most other flotation processes.

DESCRIPTION OF THE PREFERRED EMBODIMENT

Figure 1:
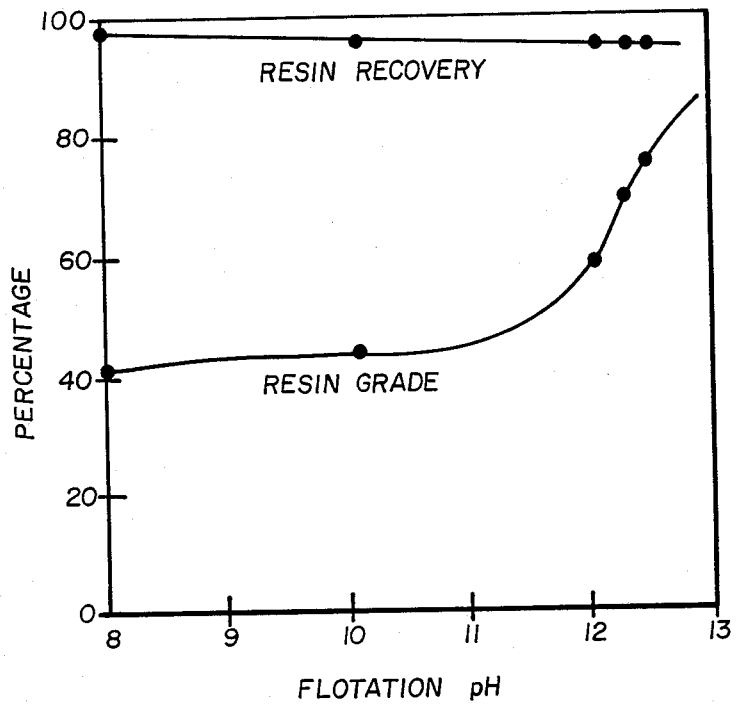
FIG. 1 is a graph depicting resin recovery and concentrate grade for single stage resin flotation from minus 28 mesh thickener underflow containing 7.2% resin as a function of flotation pH with lime for pH control.

This invention involves adjusting the pH of a mixture of resin and coal particles to a value of about 12 before flotation in order to separate selectively the resin-rich particles from the coal-rich particles.

Initially, the resin and coal particles must be reduced to a floatable size. In order for froth flotation to work on coal particles, the particles must be minute and generally be no greater than 10 mesh in size. Such a feed material can be obtained from the fine coal stream (typically minus 28 mesh however minus 10 mesh would be acceptable) at a coal preparation plant. It is to be understood that all references in this disclosure to "mesh" are to Tyler mesh.

Particle size reduction, while being essential to froth flotation, may also help to explain the excellent results obtained by the instant process. A large particle of resin-bearing coal has resinous portions embedded into the predominantly coal-containing particle. When the large particle of resin-bearing coal is comminuted into multiple smaller particles, some of the resulting smaller particles will be comprised mostly of resin (i.e., "resin-rich particles"). The resin-rich particles are therefore a small portion of the total particles present in the froth flotation process. It is usually more efficient in a flotation process to remove the minor phase with the froth and leave the predominant phase (i.e., the predominantly coal-cotaining particles) behind with the gangue.

The particle-water slurry or suspension is adjusted to a concentration of 1% to 30% by weight resinous coal. However a solids concentration of 5–15% by weight is preferred.

The pH of the suspension is then adjusted with an alkaline reagent to a pH value greater than pH 12 and the resin/coal suspension is conditioned for a short time. Industrial grade lime (calcium oxide) may be prepared for pH control at a dosage of between 2 to 20 kilograms lime per ton of dry solids (resin and coal particles). Although lime is preferred as the alkaline reagent, any basic (alkaline) chemical may be used so long as it is sufficiently basic to increase the pH of the slurry to above about pH 12. Basic chemicals containing polyvalent cations (e.g. Ca, Mg, Be, Ba, etc.) are especially preferred.

Once the pH has been adjusted, the coal particles in the resin/coal suspension selectively cluster forming particulate aggregates, consisting mainly of the coal-rich particles and behaving like much larger particles. These aggregates do not float. Resin-rich particles on the other hand remain dispersed as individual particles in the suspension.

After conditioning with the alkaline reagent, traditional frother is then added and flotation carried out, Frothers such as amyl alcohol, methyl isobutyl carbinol (MIBC), pine oil (actually an alcohol), or Dow Froth TM (a polyglycol-type frothing agent) may be used. Frothers particularly useful in separating resin from resin bearing coal particles are disclosed in U.S. Pat. No. 4,377,473 to Laros et al., the contents of which are incorporated by this reference.

As a result of the above procedures, the resin particles are separated from the predominantly coal-containing particles. The resinous particls rise with the bubbles to form part of the froth, while the coal particles aggregate.

Since the coal-rich particles aggregate they are difficult to float due to the increase in their effective size. The resin-rich particles retain their floatability and selective flotation of resin from coal can be achieved. The resin particles float and are collected in a froth product, while coal particles remain aggregated in the suspension and are rejected as tailing. In this way a high flotation recovery (>90%) and a more than adequate concentrate grade (>70%) can be achieved with a single stage process from a feed grade of less than 10% resin.

The resin concentrate obtained from the above process can be subjected to a second stage of cleaning to improve the purity of the resin concentrate. For example, the cleaner concentrate from the second stage of cleaner flotation would typically have a grade of 90% resin at a recovery from the overall feed of 65%.

The resin is then separated form the froth using techniques known to those skilled in the art (e.g., filtration, drying, or solvent extraction). Of course, multiple flotation steps can be performed to achieve even better separations.

Specific examples of the use of the invention follow:

EXAMPLE

A coal sample containing approximately 7% resin, determined by toluene extraction, was obtained from a preparation plant processing coal from the Wasatch Plateau coal field. The sample was obtained as a wet filter cake, containing 35% moisture and having a particle size of minus 28 mesh. Table 1 lists the size and resin distribution as determined by wet screening and toluene extraction.

TABLE 1

Size and Resin Distribution of the As-Received Coal Sample

| Size (mesh) | Weight (%) | Resin Content (%) | Resin Distribution (%) |
|---|---|---|---|
| +28 | 0.3 | 11.3 | 0.5 |
| 28 × 65 | 5.0 | 10.7 | 7.5 |
| 65 × 100 | 7.9 | 8.3 | 9.1 |
| 100 × 200 | 26.6 | 5.2 | 19.3 |
| 200 × 270 | 10.2 | 6.7 | 9.6 |
| 270 × 400 | 15.3 | 6.6 | 14.1 |
| −400 | 34.7 | 8.3 | 39.9 |
| Composite | 100.0 | 7.2 | 100.0 |

Selective aggregation/flotation experiments were conducted with a 2-liter Galigher flotation cell at about 15% solids by weight. Industrial grade lime was first added to the flotation cell, at the desired dosage, and the pH of the slurry was adjusted to the critical level (pH above about 12). Next the resin-coal suspension was conditioned for 10 minutes by means of agitation at 1000 rpm. During the conditioning period selective coagulation of the coal particles was observed.

After lime conditioning a blend of frothing agents (MIBC:Propanol=1:3) was added to the suspension at the desired dosage and flotation was then carried out at an air flow rate of 4 liters/minute and a stirring speed of 900 RPM for a total flotation time of 4 minutes. Resin particles were floated and collected as a froth product while the aggregated coal particles remained in the suspension.

After flotation, both the resin concentrate and the coal tailing products were filtered, dried and analyzed. FIG. 1 depicts the recovery and concentrate grade for single stage resin flotation with the selective coagulation/flotation process as a function of pH with lime used for pH control. The grade of the resin concentrate increases significantly from about 40% at pH 8 to 70% at pH 12.5 corresponding to a lime addition of 15 k/ton, while a high resin recovery exceeding 90% is maintained at pH values less than 12. The critical aspect of pH control is evident. The feed material for these tests contained 7.2% resin and a frother dosage of 0.4 kg/ton was used.

Table 2 lists the grade and recovery of the resin concentrate after two stages of the selective aggregtion/flotation process at a pH of 12.5. The rougher concentrate from the first stage was repulped with the addition of water and the procedure used for the first stage repeated except that dosages of lime and frother were varied. The levels of lime and frother listed in Table 2 include the total reagent used for both stages of flotation and are expressed as kg per ton of dry feed solids. From Table 2, it is clear that, with two stages of flotation, a cleaner concentrate containing 90% resin at a recovery of 63% can be realized. Of course in a continuous process the cleaner tailing from the second stage of flotation could be recycled and a higher recovery of the cleaner concentrate product would be realized.

TABLE 2

Grade and Recovery of Resin Concentrate From Two Stages of the Selective Coagulation/Flotation Process At Different Levels of Reagent Addition

| | Reagent Level | | Cleaner Concentrate | |
|---|---|---|---|---|
| Test | Lime (kg/ton) | Frother (kg/ton) | Resin Grade (%) | Resin Recovery (%) |
| 1 | 18 | 0.6 | 84.2 | 81.0 |
| 2 | 22 | 0.6 | 89.8 | 66.2 |
| 3 | 26 | 0.6 | 90.5 | 63.2 |

Not intending to be bound by one theory for the invention, the following may help explain the results which were obtained. The selective aggregation appears to be due to a surface chemistry difference between resin and coal particles. Coal surfaces have many oxygen functional groups and apparently these surface groups will react with calcium ions and/or calcium hydroxy complexes generated from the lime or with other alkali/alkaline earth cations to form the particulate aggregates of coal. The surfaces of resin particles have few oxygen functional groups and do not behave in the same fashion.

Although the invention has been shown in connection with a specific embodiment, those skilled in the art will recognize that many variations of this invention are possible without departing from the spirit or scope of the invention.

What is claimed:

1. A method of separating resin from minute particles of resin-bearing coal, wherein at least some of said minute particles are resin-rich and some are coal-rich, and are of a size suitable for froth flotation, comprising:

adding water to said minute particles so as to form a minute particle-water slurry;

adjusting the pH of the minute particle-water slurry to above about 12 causing coal-rich particles to aggregate;

adding a suitable frothing agent to the minute particle-water slurry; and frothing the pH adjusted minute particle-water slurry, which contains said frothing agent, to form bubbles which attach to and transport said resin-rich particles to form a froth which floats on the water.

2. The method of claim 1 wherein the pH of the minute particle-water slurry is adjusted to above about 12 by the addition of lime to the slurry.

3. The method of claim 2 wherein said minute particles of resin-bearing coal are of a size no greater than 10 mesh.

4. The method of claim 3 wherein the minute particle-water slurry contains between about one percent to about thirty percent by weight minute particles.

5. The method of claim 4 wherein the minute particle-water slurry contains between about five percent to about fifteen percent by weight minute particles.

6. The method of claim 5 including the steps of removing the froth from the water, and extracting the resinous portion from the froth.

7. The method of claim 1 wherein said frothing agent is methyl isobutyl carbinol.

8. The method of claim 7, wherein the particle size of the minute particles is 28 mesh or less.

9. The method of claim 1, wherein said minute particles are produced by reducing larger particle size resin-bearing coal.

10. A method for separating minute resin particles from a slurry mixture of minute resin particles and minute coal particles comprising adjusting the pH of the slurry mixture of minute resin particles and minute coal particles to above about 12 and subjecting the pH adjusted slurry mixture of particles to froth flotation in the presence of a frothing agent, to produce a froth fraction enriched with respect to said minute resin particles.

11. A method for separating resin from minute particles of resin-bearing coal, wherein at least some of said minute particles are resin-rich and other particles are coal-rich, said particles being of a size suitable for froth flotation, comprising:

adding water to said minute particles so as to form a minute particle-water slurry;

adjusting the pH of the minute particle-water slurry with an alkalinizing agent to above about 12;

adding a suitable frothing agent to the minute particle-water slurry;

frothing the pH adjusted minute particle-water slurry which contains said frothing agent in a frothing apparatus;

recovering the resin-rich particles from the top overflow of said frothing apparatus; and recovering the coal-rich particles from the bottom underflow of said frothing apparatus.

12. The method of claim 11, wherein the particles in said slurry are no larger than 10 mesh.

13. The method of claim 12, wherein said particles are minus 28 mesh in size.

14. The method of claim 12, wherein the slurry contains between about one and about thirty percent by weight particles.

15. The method of claim 14, wherein the slurry contains between about five and about fifteen percent by weight particles.

16. The method of claim 15, wherein the particles are minus 28 mesh in size.

17. The method of claim 16, wherein said frothing agent is methyl isobutyl carbinol.

* * * * *